US008578515B1

(12) United States Patent
Petersen

(10) Patent No.: US 8,578,515 B1
(45) Date of Patent: Nov. 12, 2013

(54) CHILD'S ROBE AND SLEEPING BAG

(76) Inventor: Jeanette N. Petersen, Los Angeles, CA (US)

( * ) Notice: Subject to any disclaimer, the term of this patent is extended or adjusted under 35 U.S.C. 154(b) by 0 days.

(21) Appl. No.: 13/549,155

(22) Filed: Jul. 13, 2012

(51) Int. Cl.
*A41D 11/00* (2006.01)
*A41D 15/00* (2006.01)
*A45F 4/12* (2006.01)

(52) U.S. Cl.
USPC ..... 2/69.5; 2/75

(58) Field of Classification Search
USPC ..... 2/93, 94, 85, 88, 89, 114, 69.5, 75, 69, 2/111, 83, 71, 72, 74, 80, 105, 108, 48, 2/52; 5/413 R; D2/719
See application file for complete search history.

(56) References Cited

U.S. PATENT DOCUMENTS

| | | | | | |
|---|---|---|---|---|---|
| 779,809 | A | * | 1/1905 | Sherick | 2/75 |
| 1,079,798 | A | * | 11/1913 | Painter | 128/873 |
| 1,247,035 | A | | 11/1917 | Tilden | |
| 1,919,154 | A | | 7/1933 | Astrove | |
| 2,227,751 | A | * | 1/1941 | Idelman | 2/69.5 |
| 2,250,750 | A | * | 7/1941 | Cole | 2/75 |
| 2,444,652 | A | * | 7/1948 | Joyce | 2/69.5 |
| 2,546,057 | A | * | 3/1951 | Bodin et al. | 2/270 |
| 2,586,961 | A | * | 2/1952 | Klein | 128/872 |
| 2,932,827 | A | * | 4/1960 | Munro, Jr. | 2/69.5 |
| 2,999,244 | A | * | 9/1961 | Wright | 2/69.5 |
| 3,787,906 | A | | 1/1974 | Hunt | |
| 4,178,637 | A | | 12/1979 | Wrightson | |
| 4,261,058 | A | | 4/1981 | Buchman | |
| 4,575,876 | A | * | 3/1986 | Weaver | 2/69.5 |
| 5,131,096 | A | * | 7/1992 | Olson | 2/75 |
| 5,226,193 | A | * | 7/1993 | Chen | 2/69.5 |
| 7,178,185 | B1 | | 2/2007 | Nattler | |
| 2012/0311764 | A1 | * | 12/2012 | Warren | 2/69.5 |

* cited by examiner

*Primary Examiner* — Amy Vanatta

(57) ABSTRACT

A child's robe convertible to a sleeping bag comprising a body portion, closed in the back and open in the front, having a hood and arms, a separate inside panel having lower and upper sections, the lower section attached to the inside of the back, at the bottom and halfway up the sides. The upper section is foldable inside of the lower section and is attached to the inside of the back for its use as a robe. The upper section can be pulled out of its inside fold, raised up and attached to the upper portion of the back for its use as a sleeping bag.

8 Claims, 3 Drawing Sheets

CHILD'S ROBE AND SLEEPING BAG

TECHNICAL FIELD

The present invention relates to a child's robe that can be converted to a sleeping bag.

BACKGROUND OF THE INVENTION

Children often visit a friend's house and sleepover for the night. Families often go camping and need sleeping bags for the children. Even at home, children will wear a robe around the house and sometimes like to sleep in a sleeping bag. A child will usually have a robe to wear around the house at bedtime and a separate sleeping bag for use in sleeping overnight at home or away. When traveling, a child's robe that can easily be converted to a sleeping bag would save room in the luggage.

SUMMARY OF THE INVENTION

It is an object of the present invention to provide a robe for a child which is easily converted to a sleeping bag when desired. The robe of the present invention comprises a body portion which is long enough so that the legs of the child are substantially covered when the child is wearing the robe. In addition the robe has a hood which fits on the child's head to keep it warm.

When worn as a robe there is a folded inner panel which is attached to the lower portion of the robe rising about one half of the length of the robe and then folds inward and downward behind the folded inner panel. The folded inner panel is removably attached to the back of the robe by an attachment, such as a ribbon, hook and loop fasteners, one or more buttons, snaps or hooks, or any other convenient attachment means. The robe also has long sleeves which will cover the arms of the child.

When it is desired to use the robe as a sleeping bag, the attachment means, which holds the folded inward portion of the inner panel, is undone and the inner portion that is folded inward and downward is pulled out and extended toward the head, creating a sleeping bag which covers the child from their toes to the child's neck or head.

In order to keep the unfolded panel portion connected to the rear portion of the robe, there are connectors at approximately the level of the armpits, such as ribbon ties or hook and loop fasteners, which hold the inner panel in place, closing the sides and creating a full body sleeping bag.

Thus, there is a child's robe, convertible to a child's sleeping bag, comprising a body portion having an inside face and an outside face running from the top of the child's head to the child's feet, the body portion enclosing the child with a closed rear section and an openable front section for its use as a robe, a separate panel having four sides and running the length of the body portion, the bottom side of the separate panel being fixedly attached near the bottom inside face of the closed rear section of the body portion, the sides of the separate panel also being affixed to the inside face of the closed rear section of the body portion, from the bottom of the inside rear section to about one-half of the way up the body portion, the top half of the separate panel being folded inside of the attached bottom half of the separate panel, with means to releasably hold the top half of the separate panel from falling downward, for use as a child's robe and pulling the top half of the separate panel fully upward, means to releasably hold the top half of the separate panel at its top for use as a sleeping bag.

DETAILED DESCRIPTION OF THE PREFERRED EMBODIMENT

Detailed embodiments of the present invention are disclosed herein, however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
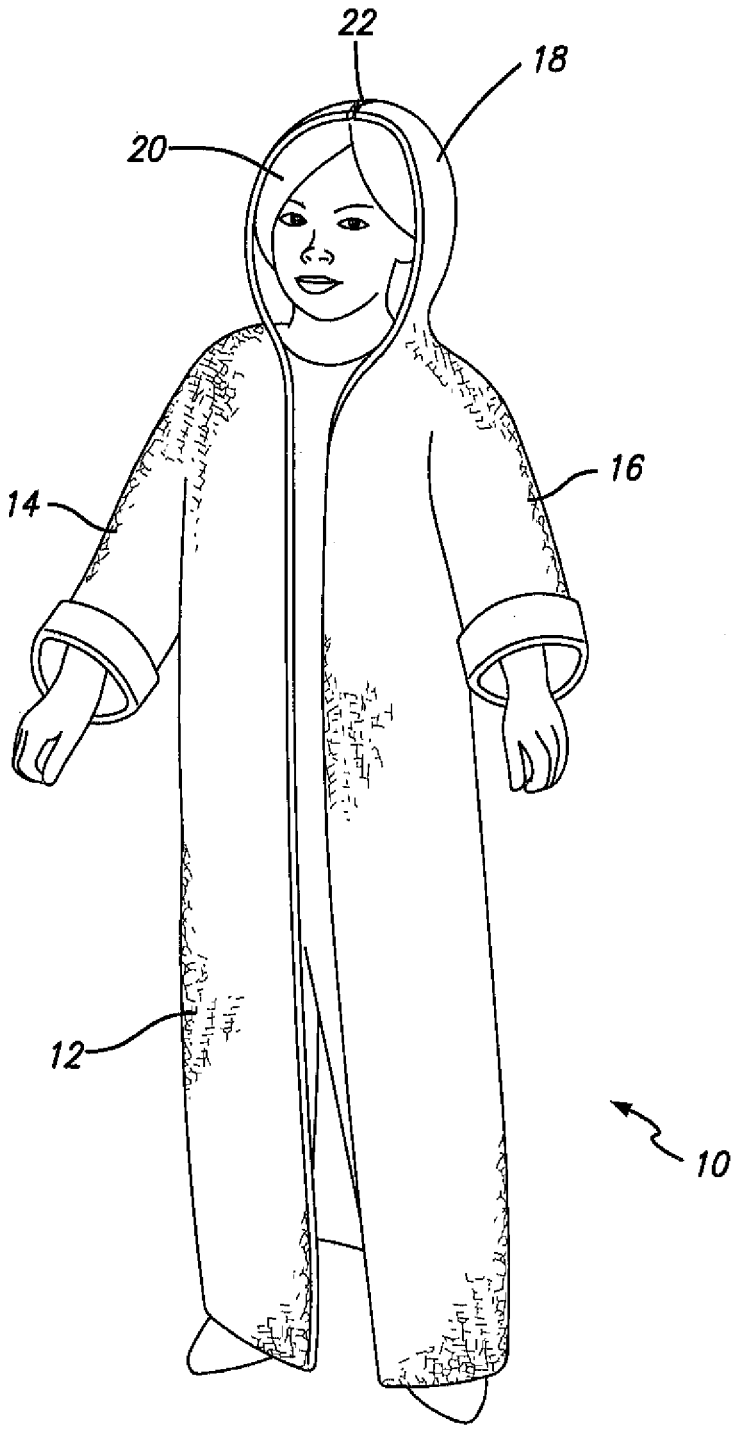
FIG. 1 is a perspective view of a child wearing the robe of this invention.

Referring now to the Figures, there is shown the robe/sleeping bag 10 of this invention. FIG. 1 shows its use as a robe 10 worn by a child 20. Robe 10 comprises a body portion 12, arm portions 14 and 16 and hood portion 18. Hood 18 has a zipper 22 used to close the hood 18 over the head of the child.

Figure 2:
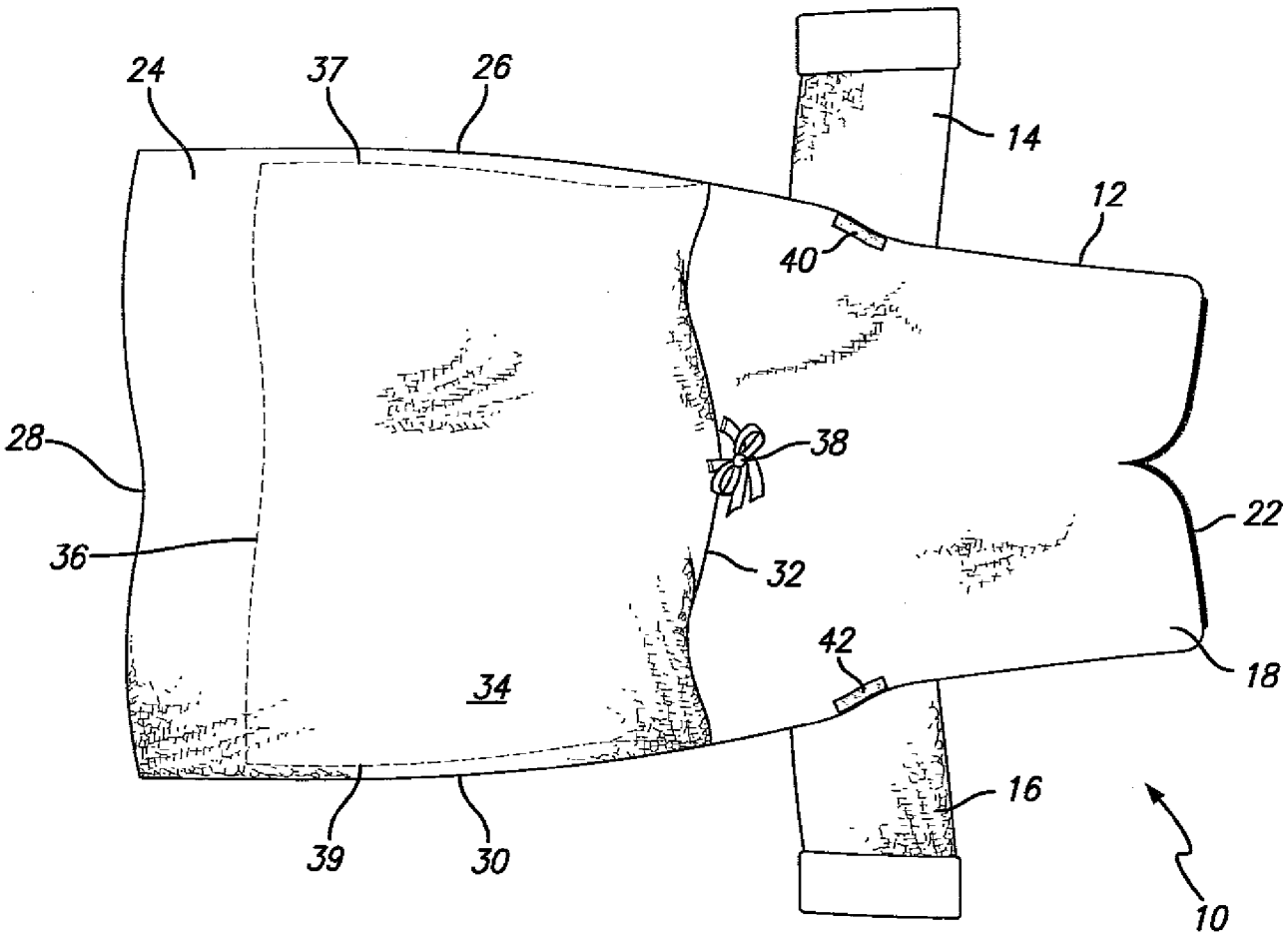
FIG. 2 is a front view of the robe laid out flat.

Referring specifically to FIG. 2, body portion 12 is folded open and comprises the entire rear of the robe 10, as shown, from the hood 18 to the very bottom, not shown, since body portion 12 is in the rear. The lower front panel portion 24 of the robe 10 is a separate panel attached on three sides 26, 28 and 30 to the rear panel 12. Panel 24 is fixedly attached to the rear portion 12 by sewing along the three sides 26, 28 and 30.

The upper visible portion of front panel 24 ends at upper edge 32, however front panel 24 is much longer, panel 34, folded inside, behind front panel 24, as shown by dotted line 36. As shown in FIG. 2, inside panel 34, which is merely an extension of front panel 24, is not fixedly connected to any other portion of the robe. Tied ribbon 38 comprises two ribbons, one attached to the inside of the rear body portion 12 and the other ribbon is attached to the front panel 24 at fold 32. The tied ribbons 38 hold panel 24 in place and prevent front panel 24 from falling downward. While ribbons are shown, any convenient tying means can be used, such as hook and loop fasteners, buttons, snaps or hooks. For younger children, hook and loop fasteners and ribbons are preferred for safety's sake, as buttons, snaps and hooks could be swallowed.

Figure 3:
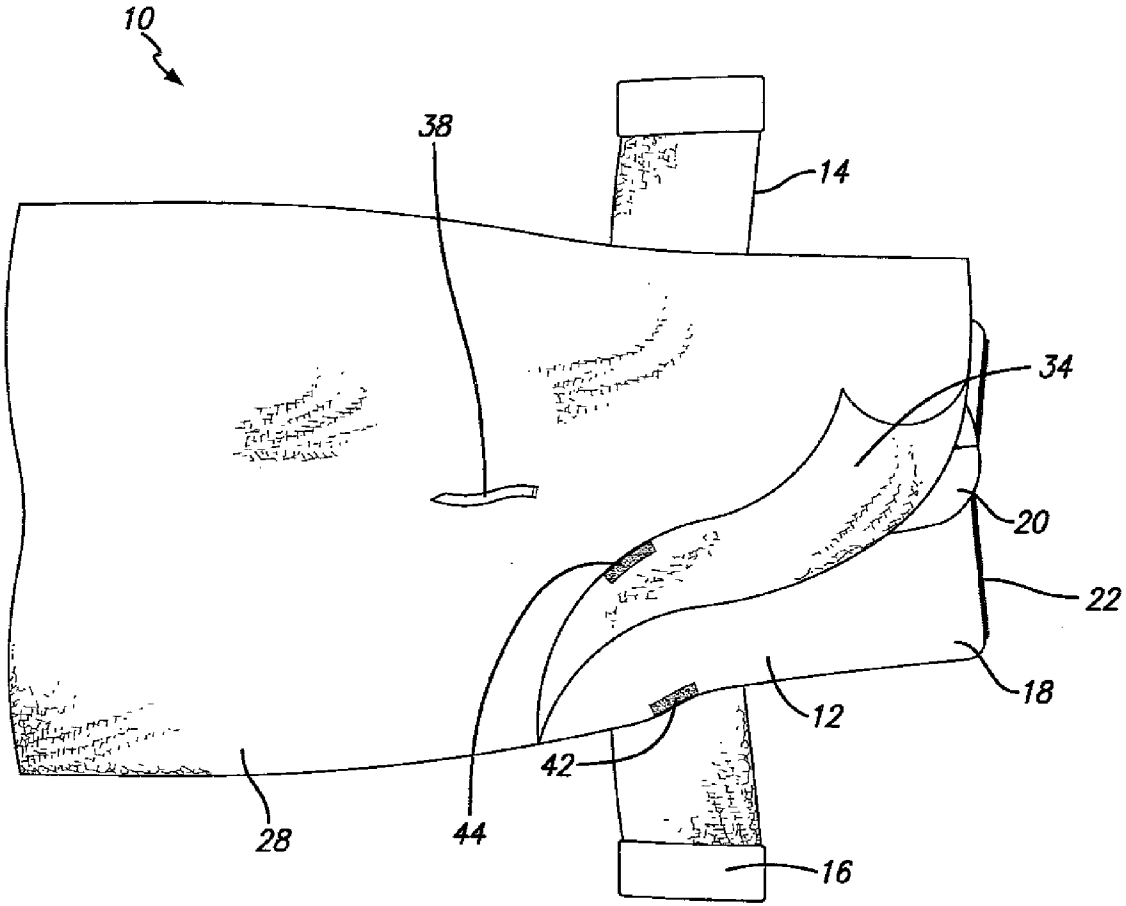
FIG. 3 is a perspective view of the child using the robe as a sleeping bag.

Referring to FIG. 2 and FIG. 3, there is shown a pair of hook and loop fasteners 40 and 42 attached to the rear body 12, each near the armpit area. When the folded inward panel 34 is unfolded and pulled upward (FIG. 3) there is a hook and loop fastener 44 which connects to hook and loop fastener 42. There is a similar hook and loop fastener on the other side, not shown, on the back of panel 34, which connects to hook and loop fastener 40. When these fasteners are connected, robe 10 becomes a sleeping bag. Again, these fasteners could be ribbons, buttons, snaps or hooks, or any other convenient fastening means. Fasteners 40 and 42 can be attached lower than the armpit area or higher than the armpit area depending upon the desire of the manufacturer. There can also be more than one fastener similar to fasteners 40, 42 or one long hook and loop fastener up the side of rear panel 12 and the backside of panel 34. There can also be a series of buttons, hooks or snaps up the side to keep the sides of the sleeping bag tightly closed.

The robe/sleeping bag of the invention can be made from cotton, wool or any other suitable fabric. A particularly good fabric is a faux fur material on the outside of rear panel 12 and a cotton fabric on the inside of rear panel 12 and the same cotton fabric for the inner panel 28-34. This provides a warm robe and a warm sleeping bag. Converting the robe to a sleeping bag and from a sleeping bag to a robe can be accomplished very quickly. Also, young children become very attached to their robe and because of the easy transition, their sleeping bag as well.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. While various embodiments could have been described as providing advantages or being preferred over other embodiments, those of ordinary skill in the art recognize that one or more features or characteristics can be compromised to achieve desired overall attributes, which depend on the specific application and implementation. Having thus described the invention:

What is claimed is:

1. A child's robe, convertible to a child's sleeping bag, comprising a body portion having an inside face and an outside face running from the top of the child's head to the child's feet, the body portion enclosing the child with a closed rear section and an openable front section for its use as a robe, a separate panel having four sides and running the length of the body portion, the bottom side of the separate panel being fixedly attached near the bottom inside face of the closed rear section of the body portion, the sides of the separate panel also being affixed to the inside face of the closed rear section of the body portion, from the bottom of the inside rear section to about one-half of the way up the body portion, the top half of the separate panel being folded inside of the attached bottom half of the separate panel, with means to releasably hold the top half of the separate panel from falling downward, for use as a child's robe and pulling the top half of the separate panel upward, with means to releasably hold the top half of the separate panel, near or at its top, for use as a sleeping bag.

2. The child's robe, convertible to a child's sleeping bag of claim 1 in which the top of the body portion is shaped as a hood.

3. The child's robe, convertible to a child's sleeping bag of claim 1 in which the means to releasably hold the top half of the separate panel from falling comprises a member from the group consisting of ribbons, hook and loop fasteners, buttons, hooks and snaps.

4. The child's robe, convertible to a child's sleeping bag of claim 1 in which the means to releasably hold the top half of the separate panel from falling when it is pulled upward comprises a member from the group consisting of ribbons, hook and loop fasteners, buttons, hooks and snaps.

5. The child's robe, convertible to a child's sleeping bag of claim 1 in which the body portion also comprises arms.

6. The child's robe, convertible to a child's sleeping bag of claim 3 in which a portion of the ribbons, hook and loop fasteners, buttons, hooks or snaps is attached to the separate panel and the other corresponding portion is attached to the inner side of the rear body portion.

7. The child's robe, convertible to a child's sleeping bag of claim 6 in which a portion of the ribbons, hook and loop fasteners, buttons, hooks or snaps are located at the level of the arms.

8. The child's robe, convertible to a child's sleeping bag of claim 1 in which the body portion is made of faux fur on the outside and cotton or wool fabric on the inside.

* * * * *